United States Patent [19]

Randolph

[11] Patent Number: 4,893,765

[45] Date of Patent: Jan. 16, 1990

[54] FRICTION CORE HOLDER

[76] Inventor: Glenn E. Randolph, 5234 Furman Rd., Charlotte, N.C. 28210

[21] Appl. No.: 301,633

[22] Filed: Jan. 25, 1989

Related U.S. Application Data

[63] Continuation-in-part of Ser. No. 115,484, Nov. 2, 1987.

[51] Int. Cl.[4] ..... B65H 75/22; B23B 31/40

[52] U.S. Cl. ..... 242/72 R; 279/2 R

[58] Field of Search ..... 242/72 R, 68.5, 46.4, 242/46.6; 279/2 R

[56] References Cited

U.S. PATENT DOCUMENTS

| | | | |
|---|---|---|---|
| 1,918,522 | 7/1933 | Crane | 279/2 R X |
| 2,196,489 | 4/1940 | Bennett | 242/72 R |
| 2,219,124 | 10/1940 | Bandy | 242/72 R |
| 2,790,246 | 4/1957 | May | 279/2 R |
| 3,593,933 | 7/1971 | Grashorn | 242/72 R X |
| 3,963,250 | 6/1976 | Flagg | 242/72 R X |

*Primary Examiner*—Stuart S. Levy
*Assistant Examiner*—Steven M. DuBois
*Attorney, Agent, or Firm*—Ralph H. Dougherty

[57] ABSTRACT

A core holder for a winding apparatus for winding webs of material in the paper, printing, and textile industries, including a rotatable core-receiving spindle or mandrel, and a segmented friction core holder, expandable outwardly at selected points, by which the core is tightly gripped when the mandrel is turning, and which readily releases its grip on the mandrel upon a simple manual maneuver by the operator, and is readily removable with little force. The core holder assembly is round, but the mandrel-receiving hole has segmented arcs which are not concentric with the outer surface of the core holder, creating stops which limit the movement of the segments about the mandrel.

21 Claims, 7 Drawing Sheets

FRICTION CORE HOLDER

CROSS REFERENCE TO RELATED APPLICATION

This application is a continuation-in-part application of U.S. patent application Ser. No. 115,484, filed Nov. 2, 1987.

BACKGROUND OF THE INVENTION

The present invention relates to a device for winding reels of material onto a core. More particularly, the present invention relates to an core holder assembly for tightly gripping and holding a resilient core on a mandrel for the winding of defined lengths of webs onto such core. The invention is particularly useful in the manufacture of labels in the printing industry, and is readily adaptable to the textile and other industries which wind sheets of material onto a core while the core is situated on a mandrel, then remove the filled core and replace it with an empty core.

In the manufacturing of labels, after printing, it is necessary to rewind reels of label-carrying webs bearing large quantities of labels onto smaller rolls of accurate and defined quantities of labels. In actual manufacture, it requires about twice as much time and accompanying manpower to rewind the labels as to accomplish the original manufacture or printing of the labels.

The present invention provides means for holding cores onto a mandrel or spindle when transferring large reels of labels onto small rolls or cores with excellent holding power, yet having ready removability and with a reduction in the manpower required for the current core installation and removal process.

Although applicable to many industries, the present invention will be described in relation to the manufacture of labels. A label auto-transfer turret rewind apparatus is basically a rotatable base plate having a plurality of protruding mandrels or spindles, each spindle adapted to receive and rotate a take-up spool, which spindles are journaled for rotation in the base. Each spindle is powered by a drive mechanism, which may be individual or common to all spindles. A counter controls a cut-off mechanism for accurately placing the correct number of labels on each spool or core, upon which the spindle rotates to a specified indexed position, and the spool is removed.

BRIEF DESCRIPTION OF THE PRIOR ART

Although a search was made, no segmented core holder similar to the invented core holder was located.

The following patents are believed to be exemplary of the prior art with regard to the subject invention:

Kupper U.S. Pat. No. 4,651,865, entitled Device for Unloading a Coil, shows mandrels and coils for textile threads, the coils being rotated by end contact to drive means.

Rohde U.S. Pat. No. 4,390,138, entitled Reeling Apparatus for a Web, shows presently used core tubes on a modern winding shaft, which has no provision for tightly holding the core tube to the shaft.

Most patents covering winders and rewwinders fail to show details of core holders. Such patents are exemplified by:

Marshal U.S. Pat. No. 4,518,126, entitled Take-Up Mechanism, which shows a winding takeup mechanism for controlling webs on tubes;

Cooper U.S. Pat. No. 4,416,426, entitled Web Treatment Apparatus, which shows four mandrels which index to various positions;

Clements U.S. Pat. No. 4,526,638, entitled Apparatus and Method for Joining Webs, which shows an expandable drivable support for reel core ends, which are only laterally expandable for reels of different widths;

Taitel U.S. Pat. No. 3,930,620, entitled Turret Rewinder, which teaches a core C on an apparently round spindle, and fails to suggest any means for causing both the spindle and the core to rotate at the same angular velocity;

Nichols U.S. Pat. No. 1,484,842, entitled Slitting and Rewinding Machine; and

Mulfarth U.S. Pat. No. 4,630,783, entitled Machine for Winding a Web of Paper on a Roll.

SUMMARY OF THE INVENTION

The invention is a core holder for a winding apparatus, including a core-receiving mandrel of specified geometric cross-section, journaled for rotation, a segmented friction core holder, expandable outwardly at selected points, by which the core is gripped when the mandrel is turning, and which readily releases its grip on the mandrel upon a simple manual maneuver by the operator. The mandrel is preferably connectable to drive means, but must also be capable of "idling", that is, being undriven at a specified instant.

OBJECTS OF THE INVENTION

It is the primary object of this invention to provide means of holding a core tightly on a mandrel for winding of a web onto the core.

It is also an object of this invention to provide a means of easy removal of a core from a mandrel.

It is also an object of this invention to provide apparatus for winding webs of material which is equally adaptable to the paper, printing, and textile industries.

BRIEF DESCRIPTION OF THE DRAWINGS

The foregoing and other objects will become more readily apparent from the following detailed description and the appended drawings, in which.

DETAILED DESCRIPTION

Figure 1:
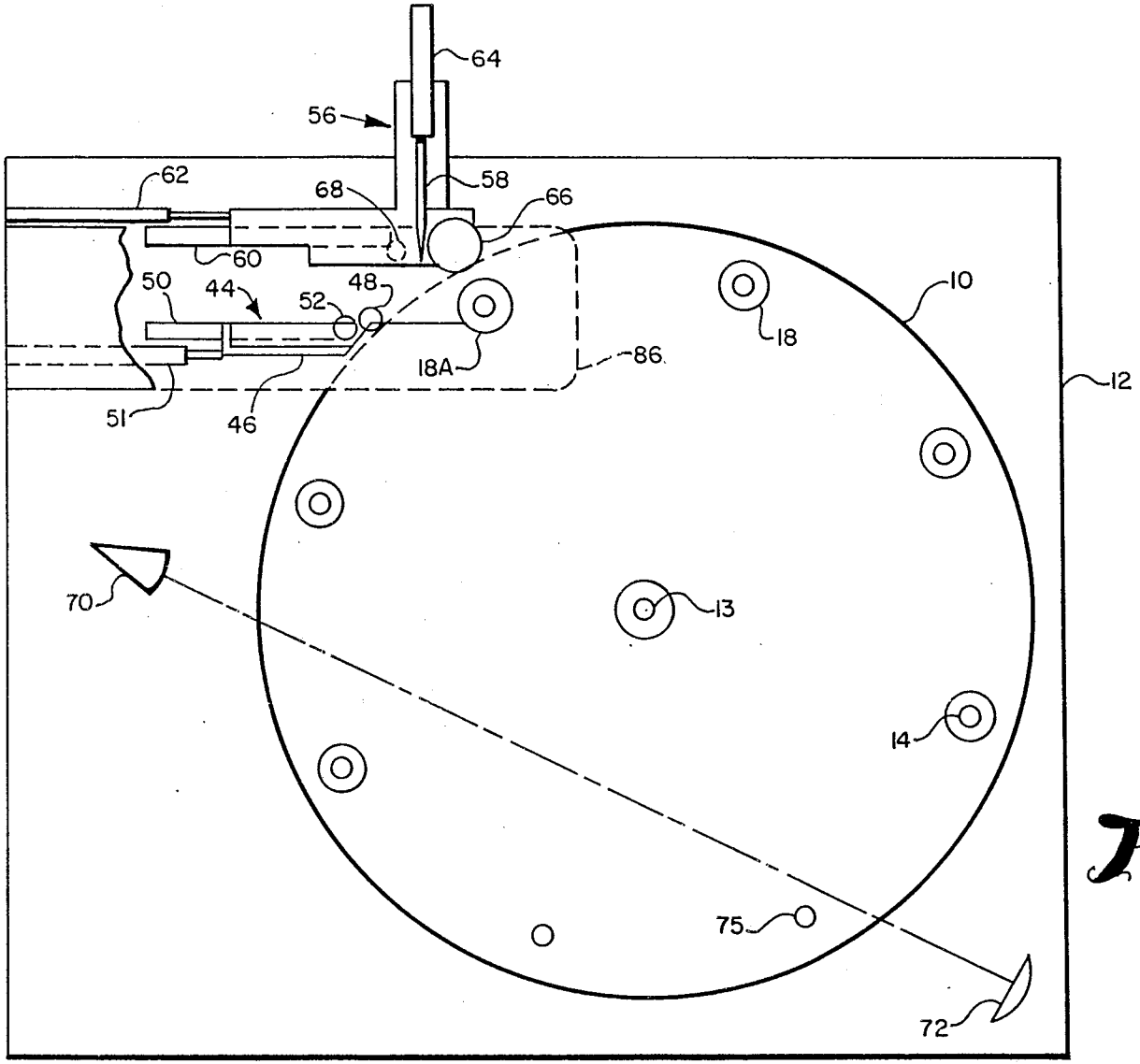
FIG. 1 is a front view of a label auto-transfer turret rewind assembly on which the invented core holder is advantageously used.

Referring now to FIG. 1, which depicts the invention in use in the lable printing industry, a large disc 10 is mounted for rotation on a base 12, about axis 13. The disc 10 is provided with 8 label friction mandrels or spindles 14, all of which protrude from one side of disc 10 and are driven from the other side.

Figure 3:
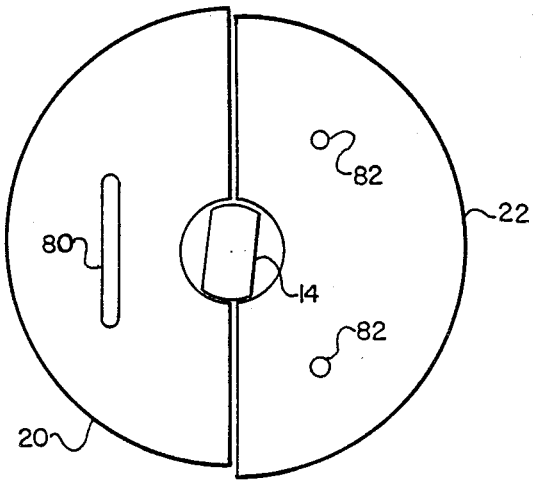
FIG. 3 is an isometric view of one embodiment of the invented friction core holder in the deactivated position.
Figure 4:
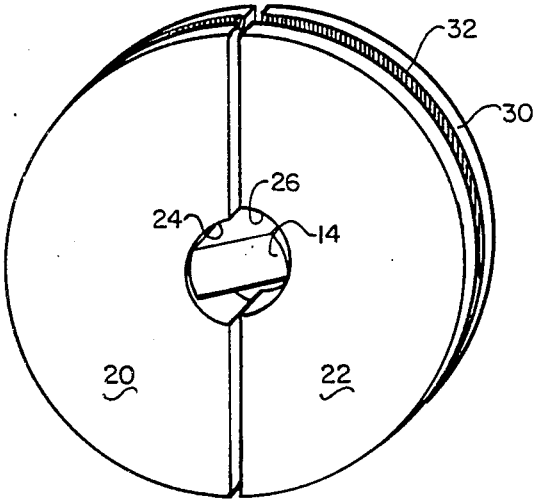
FIG. 4 is an end view of the friction core holder of FIG. 3 in the activated position, showing two alternative embodiments of core holder segment connectors.

Each mandrel 14, which has a longitudinal flat or planar face 16, holds a core 18, which is generally made of cardboard, fiberboard, vinyl, plastic, or other resilient material. The core is held onto the mandrel 14 by a pair of semi-circular disc-like segments 20, 22, which have slightly offset respective centers 24, 26. Each segment 20 is identical to segment 22, but is reversed when mated. Mandrel 14 has a pair of opposed longitudinal planar faces 28, which accomodate the off-set centers in the non-round orientation, as shown in FIG. 3. The segments preferably have an annular outer groove 30 for receiving a resilient band or O-ring 32 to hold the mated segments together. Mandrels 14 are preferably made from steel, however, they can be made of any metal or alloy, wood, hard rubber, hard plastic, or the like.

Figure 2:
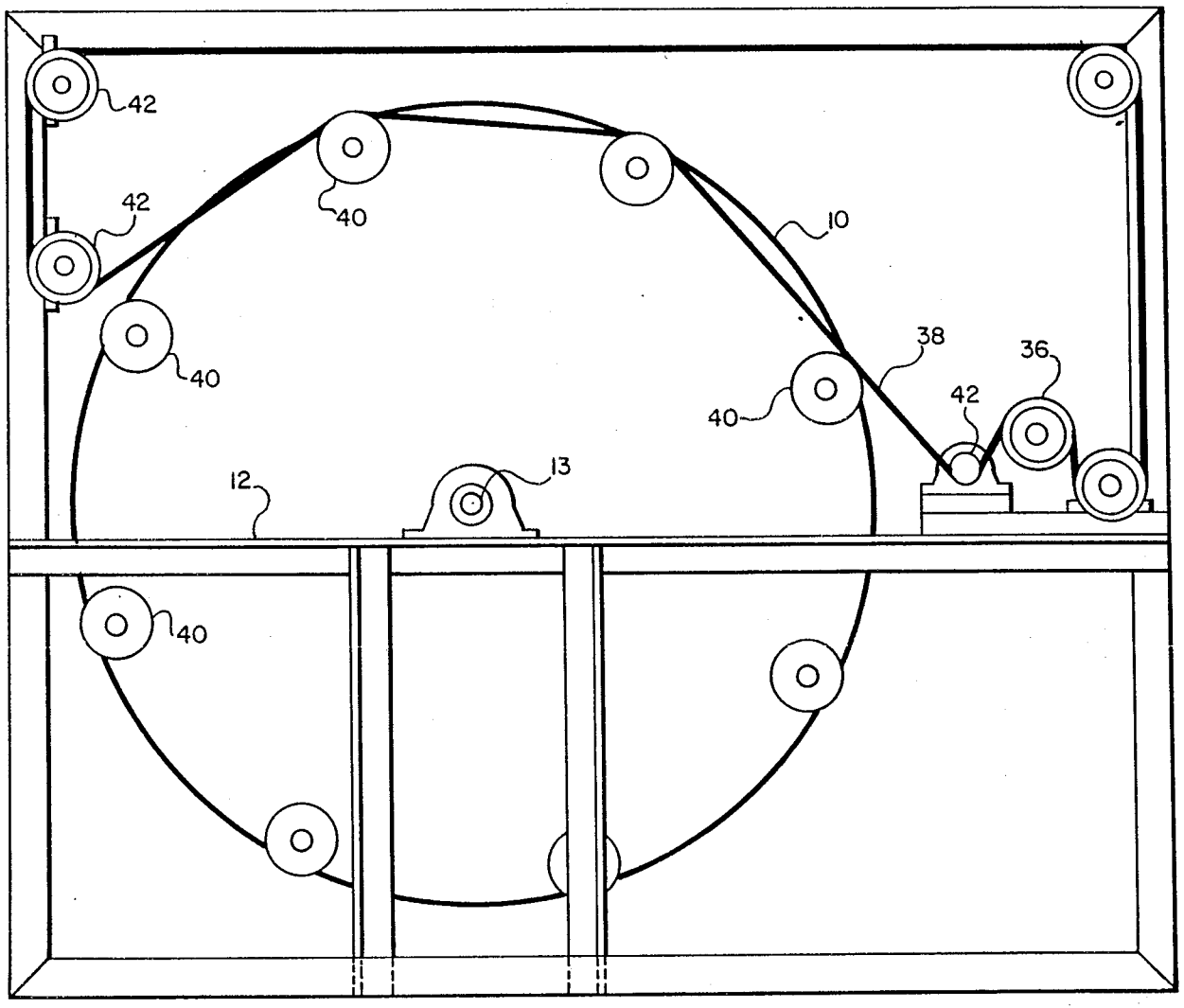
FIG. 2 is a rear view of the label turret rewind assembly of FIG. 1.

The reverse side of the turret rewind base 12 carries drive means, including a motor driven sheave 36, and a drive sheave arrangement in which drive belt 38 engages only two or three of the mandrel drive sheaves 40 at any one time (See FIG. 2). Idler pulleys 42 are provided to create proper tension in belt 38 and the proper drive angle of belt 38 with regard to each sheave 40 in a driven position.

A glue unit 44 includes a glue-containing receptacle or trough 46, a roller-applicator 48 mounted at the trough so that a portion of the roller extends into the glue contained in the trough, and means for moving the glue unit laterally into and out of engagement with a core on a spindle. The glue unit is mounted on a track 50 which is connected to the frame 12, and is preferably reciprocally powered along the track by a pneumatic cylinder, not shown. The glue unit may advantageously carry a lower glue carrier roll 52 which is partially submerged in the glue pool and contacts the roller-applicator 48 by which the carrier roll applies glue to the applicator roll 48, which allows the applicator roll to be of a smaller diameter than otherwise would be required to extend into the glue pool in the trough. In addition, the use of a carrier roll will prevent excessive glue from being applied to the carrier roll and thus to the core.

A web cutting assembly 56, including a cutting blade 58, is mounted for horizontal movement on a track 60, which is fixed to frame 12. A solenoid-actuated pneumatic cylinder 62 is connected to the blade assembly for horizontal movement along the track 60. Another solenoid-actuated pneumatic cylinder controls vertical movement of the blade. The cutting assembly includes a web guide roll 66, which is an idler roll that controls the angle and path of the web as it is being cut, as well as preventing the moving web from contacting the knife blade 58 and causing a "cobble", or mishap. If desired, the blade 58 can be set to cut at an angle of up to 45 degrees from the vertical. Contact roller 68 pushes the web against the glued core momentarily, simultaneously with retraction of the knife blade 58.

The indexing of each core-containing mandrel to the next position is automatically controlled. A counter may be provided to accurately count the number of labels on the core, whereupon when a predetermined number is reached it would generate a signal to activate movement of the cutting assembly and blade, then to index the mandrel to the next position by rotation of the disc plate to its new orientation, and activate the glue unit to apply adhesive to a newly positioned core in the standby position.

A detector, comprising a photoelectric cell 70, is focused at a location indicated by reflector 72, and is so adjusted that its beam is aimed to just miss a mandrel if it carries no core thereon, but the beam will be interrupted by a filled core or roll. The detector is provided with an audible alarm which also controls an emergency stop for preventing further indexing of the turret apparatus until the label or web-containing roll can be removed from the mandrel at the focused position indicated at 75.

A safety guard 86 may be provided to prevent contact of any person with the cutting blade.

Figure 11:
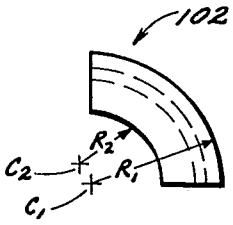
FIG. 11 is an end view of the segment of FIG. 10.

The preferred core holder embodiment is shown in FIGS. 10 through 13. The center $C_1$ of the outer arc having radius $R_1$ is not coincident with center $C_2$ of the bore having radius $R_2$. The center $C_2$ of the bore is offset from center $C_1$ from 0.015 to 0.35 inches (about 0.4 to about 9 mm), as shown in FIG. 11, but preferably from 0.025 to 0.055 inches (about 0.63 to about 1.4 mm).

Figure 13:
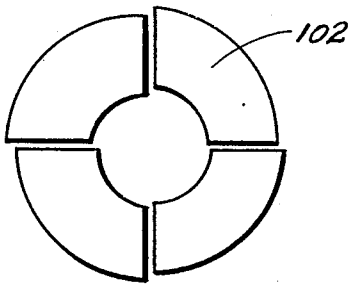
FIG. 13 is an end view of the assembled core holder of FIG. 12.
Figure 10:
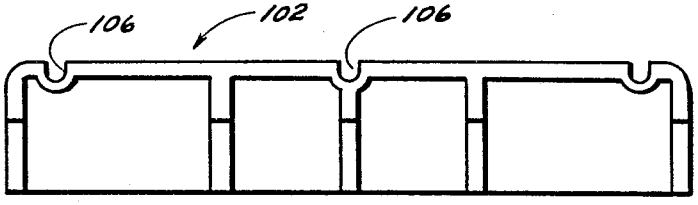
FIG. 10 is a side view of a single segment of a 4-segment core holder.
Figure 12:
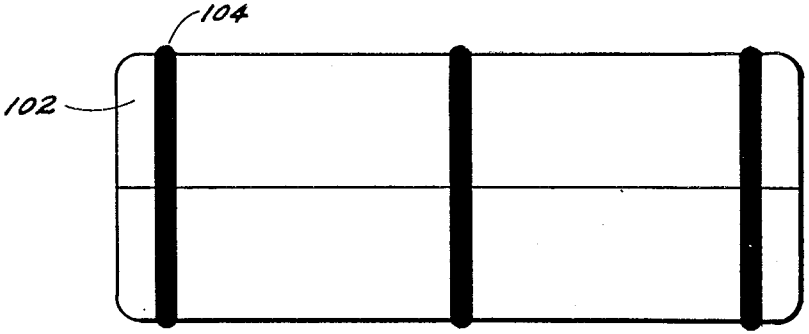
FIG. 12 is a side view of an assembled 4-segment core holder using the segments of FIG. 10.
Figure 14:
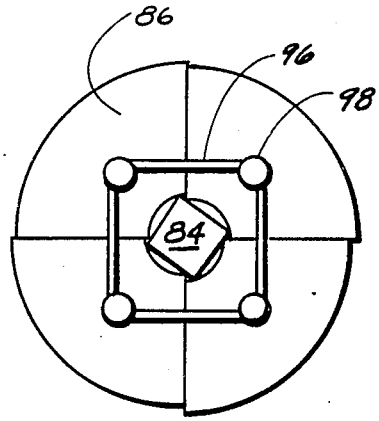
FIG. 14 is an end view of a 4-segment friction core holder showing an alternative segment connecting means.
Figure 15:
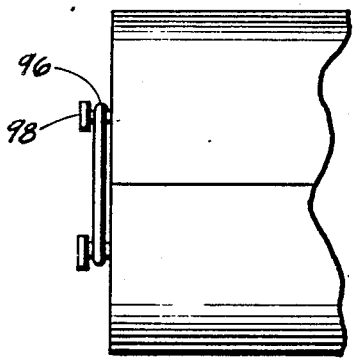
FIG. 15 is a partially cutaway side view of the friction core holder of FIG. 14.

Four identical segments 102, as shown in FIGS. 10 and 11 are assembled with connectors, preferably resilient connectors such as O-Rings 104 in grooves 106 as shown in FIGS. 12 and 13 to form a core holder. When the segments are assembled, they provide a nonround hole for accomodating the mandrel, with stops preventing more than a quarter turn of the core holder about the mandrel.

In operation, a core 18 is placed on a mandrel 14, prior to the mandrel being indexed to the location for web accumulation. As it approaches location 18A, the mandrel begins turning, as its associated drive sheave 40 is engaged by drive belt 38. Upon reaching the core location indicated at 18A, the glue unit is activated to move horizontally until the applicator roll 48 touches a core for one core revolution, the applicator applying glue for one revolution, the exact time of the glue application being computer controlled. The glue unit retracts. When the active core is filled, the cutting unit moves forward to slice the label-containing web, the turret indexes, and the glue unit applies adhesive to the next core.

The action of the blade dropping and slicing the web actually forces the web down against the adhesive-bearing core, and immediately upon blade retraction, the core is already accumulating labels. Then the turret 10 indexes to the next station, meaning that the plate disc has revolved ⅛ of a revolution. The label-filled core 18 is removed after the turret has indexed twice, so that the associated drive sheave for the mandrel which that core is gripping is no longer engaged by drive belt 38, and the mandrel is no longer turning. The empty core is turning prior to the glue being applied, and the core is also turning while it is filling. Then when it indexes to the next station, it can be removed.

The elongated flat sides of each mandrel accomodate the core support segments when offset to the non-circular central orifice orientation. When the spindle 14 turns in an operative direction, it forces the split center of the core-gripping segments to assume a round configuration, rather than that of two slightly off-set half-moons. Reverse pressure on the core will release the outward force from the mandrel and allow the core to be readily removed therefrom.

A rewind machine is used to rewind the large rolls into small, easily handled rolls for a label applicator, such as a portable label applicator. Use of the subject invention allows the quicker installation of cores and removal of filled rolls, with an attendant reduction of required personnel time for these operations.

ALTERNATIVE EMBODIMENTS

Alternatively, the semi-circular core support segments may be wider than shown, thus requiring only one pair of segments to support a core. When two pairs of segments are used, each opposed pair may be connected by a spacer 80, as shown in FIG. 3, or by a pair of spacers 82, such as dowel rods.

Figure 7:
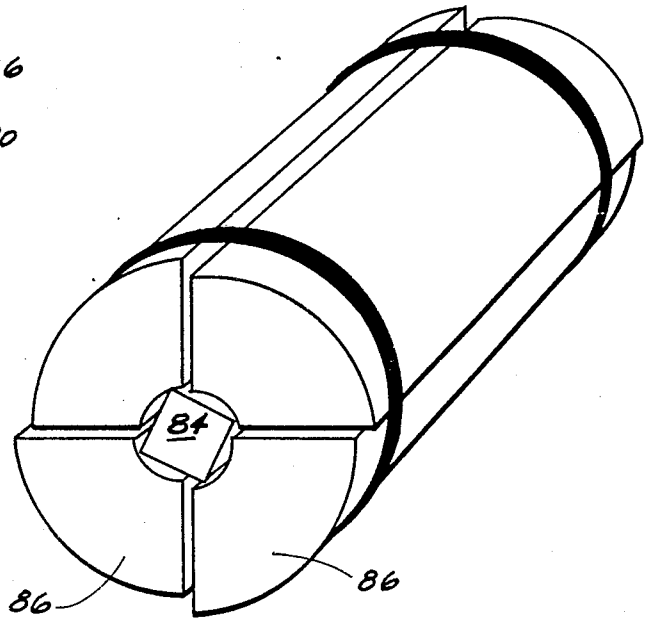
FIG. 7 is an end view of the friction core holder of FIG. 6 in the activated position.
Figure 6:
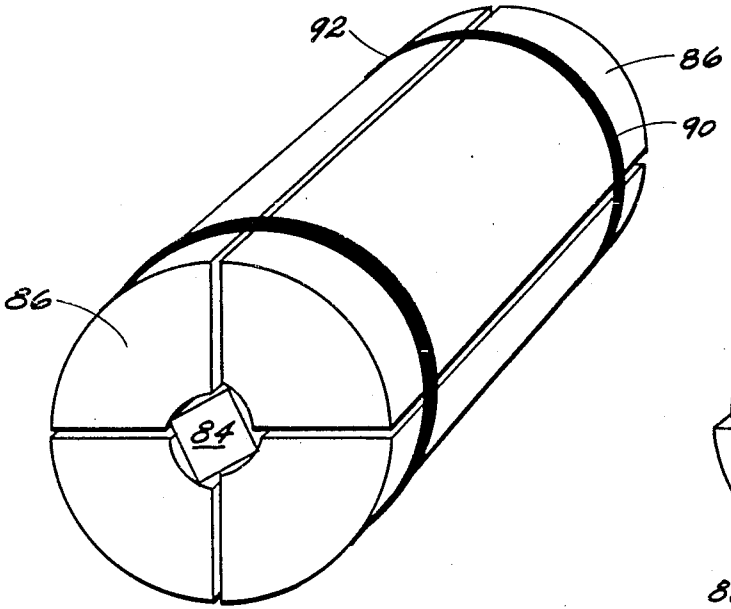
FIG. 6 is an isometric view of an alternative friction core holder in the deactivated position.
Figure 9:
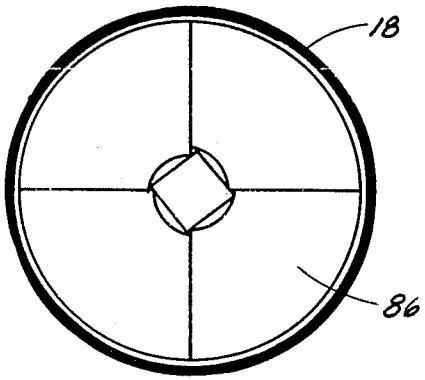
FIG. 9 is an end view of the friction core holder of FIG. 8 in the activated position.
Figure 8:
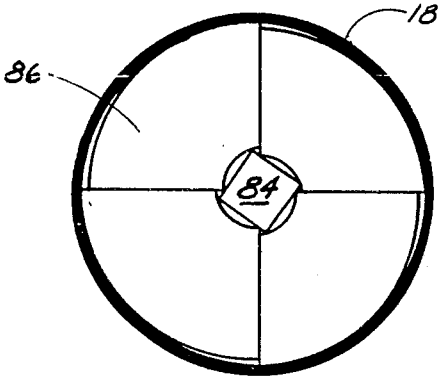
FIG. 8 is an end view of another alternative friction core holder in the activated position.

In the embodiment of FIGS. 6 and 7, each mandrel 84, which has longitudinal flat faces, has a square cross-section. A core is held onto the mandrel 84 by four quad-circular disc-like segments 86, which have slightly offset respective center openings 88 to accomodate the mandrel. Each segment 86 is identical. As shown, four such segments form a completed core holder, when assembled. When the core holder is turned about the mandrel 84, one edge of each segment 86 is forced outwardly, as shown in FIGS. 7 and 8, tightening against the inner surface of the core 18. Upon a reverse twist, the segments of the core holder return to the positions shown in FIGS. 6 and 9, releasing their grip on the core.

Figure 5:
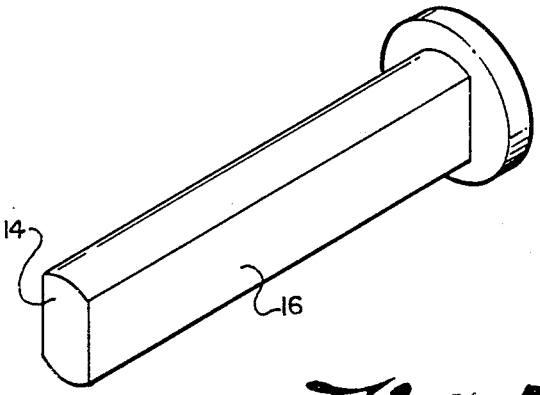
FIG. 5 is an isometric view of a mandrel in accordance with the invented core holder embodiments of FIGS. 3 and 4.
Figure 17:
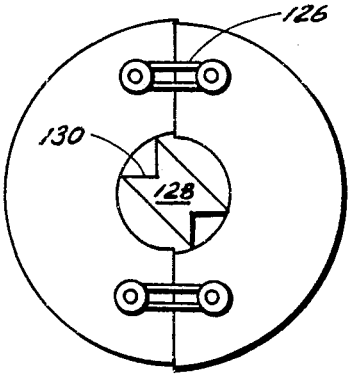
FIG. 17 is an end view of a 2-segment friction core holder showing both alternative mandrel configurations and alternative segment connecting means.

The 2-segment embodiment depicted in FIGS. 5 and 17 utilizes a mandrel 14 or spindle, which has a pair of wide longitudinal flat faces 16, and a pair of short faces, which may be arcuate, either concave which accomodate the off-set centers in the non-round or convex, or flat, or may have any desired configuration that will not extend beyond the arc of the core segments, as shown in FIG. 3. The segments preferably have an annular outer groove for receiving a resilient band or O-ring to hold the mated segments together. The band may be seated low enough in the groove that it does not contact the core, or it may contact the core. In another alternative embodiment, there may no groove at all, and the bands will be prssed into contact with the core in the gripping position of the core holder.

The mandrel is constructed of harder material than the segments. Wear of the mandrel or spindle is minimal when the spindle is hard or hardened material such as steel, and the segments are readily replaceable softer materials such as wood, plastic, fibrous material, or other similar materials. When the segments are themselves a resilient material capable of holding by friction, such as rubber or polyvinyl chloride, the core material may be a hard wear resistant material, such as wood, hard plastic, metal, metal alloy, even stainless steel, and the invention is still readily operable.

The segments may be held together as shown in FIG. 6 by O-rings 90 in annular grooves 92. Alternatively, they may be connected loosely by any convenient connecting means that avoids interference with the operation of the segments, such as O-Rings 96 on pins 98 extending from the end faces of each segment 86, as shown in Fugres 14 and 15; wire connectors such as wire 110 having end loops for attaching to pins 112 on adjacent segments; rubber or resilient connectors 116 between fasteners 118 on adjacent segments, or other suitable connecting devices which will loosely maintain the segments in the proper juxtaposition.

Figure 16:
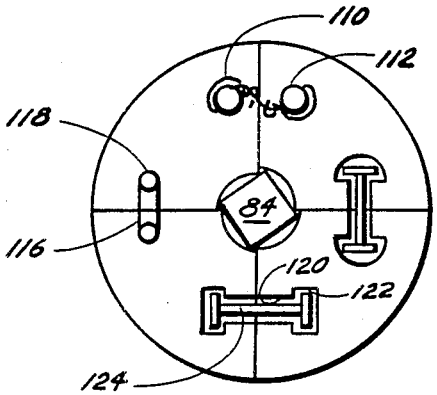
FIG. 16 is an end view of another 4-segment friction core holder showing several alternative connector devices.

Also shown in FIG. 16 is an alternative connecting means which comprises a slot 120 in each end face of each segment mating with an adjacent slot in the opposed segment and having an expanded recess 122 therein, and a double headed connector 124 with a shank between the heads engaged within said expanded recess to hold the segments loosely together.

The mandrel preferably has a regular polygonal cross section, such as an equilateral triangle, square, hexagon, etc. When the mandrel is a regular polygon, the core holder assembly has the same number of segments as the polygon has sides, and the centers of the outer and inner arcs of each segment are offset the same amounts as stated previously.

FIG. 17 shows an alternative embodiment of a 2-segment core-holder which is held by a pair of resilient connectors 126 in the same manner as the four-segment core holder connector 116, 118 of FIG. 16. In a 2-segment core holder, the mandrel 125 can have any rectangular cross-section configuration, and can have one or more recessed faces 130.

An alternative glue applicator unit includes a pressure spray dispenser directed to the core position at the glue applicator station, with associated glue supply. The spray dispensing heads can be mounted for horizontal movement toward and away from the active position, and each head is capable of being shut off without clogging by rotation to a standby position opening upwardly.

SUMMARY OF THE ACHIEVEMENTS OF THE OBJECTS OF THE INVENTION

From the foregoing description, it is readily apparent that I have invented apparatus for holding a tubular core tightly on a mandrel or spindle, yet which is readily removable with ease, and which is equally adaptable to the paper, printing, and textile industries, including the carpet industry.

While I have shown and described present preferred embodiments of the invention, it is to be understood that the invention is not limited thereto or thereby, but any changes or modifications within the scope of the following claims are included within the invention.

What is claims is:

1. Apparatus for holding a coiling tube on to a mandrel, said mandrel having longitudinal flat surfaces, said apparatus comprising a plurality of arcuate tube insert segments, each of said segments having an inner arc, an outer arc, and two end sections defining the entire peripheral edge of the segment, each of said inner arcs and said outer arcs having a corresponding center point defining a circle upon which each of said inner and outer arcs lie respectively, wherein the centerpoint of said inner arc and the centerpoint of said outer arc are offset by a predetermined distance of from about 0.015 to about 0.35 inches, whereby when said arcuate segments are mated, the peripheral edges abut to form stops that limit the relative rotation of the mandrel and the apparatus.

2. Apparatus according to claim 1, wherein the mandrel material is harder than the segment material.

3. Apparatus according to claim 1, wherein the mandrel is made from a material selected from the group consisting of metal, wood, and hardened plastic.

4. Apparatus according to claim 3, wherein the mandrel is steel.

5. Apparatus according to claim 1, wherein the segments are a resilient material.

6. Apparatus according to claim 1, wherein the segments are made of a material selected from the group consisting of rubber, wood, and plastic.

7. Apparatus according to claim 1, wherein the segments are mated and held in juxtaposition by connecting means.

8. Apparatus according to claim 7, wherein the connecting means is at least one resilient connector encircling said mated segments.

9. Apparatus according to claim 7, wherein the connecting means comprises at least one pin on the end face of each segment, and a resilient connector placed around the pins.

10. Apparatus according to claim 9, wherein the resilient connector is an O-ring.

11. Apparatus according to claim 7, wherein the connecting means comprises wire connectors loosely fixed to adjacent faces.

12. Apparatus according to claim 7, wherein the connecting means comprises a slot in each end face of each segment mating with an adjacent slot, and having an expanded recess therein, and a doubleheaded connector with a shank therebetween engaged within said expanded recess to hold the segments loosely together.

13. Apparatus according to claim 1, further comprising an annular groove in the circumference of each of said segments, and a resilient fastener positioned in said groove to mate said segments.

14. Apparatus according to claim 1, wherein the cross section of said mandrel is a regular polygon having from three to eight sides, and said tube-holding apparatus comprises the same number of segments as the sides of said regular polygon.

15. Apparatus according to claim 1, wherein the center of the circle defining the outer arc of a segment is off-set from the center of the circle defining the inner arc of the mandrelreceiving central cutout from 0.025 to 0.055 inches.

16. Apparatus for holding a coiling tube having a resilient surface onto a mandrel, said mandrel having opposed longitudinal planar surfaces, said apparatus comprising a pair of semi-circular tube insert segments, each of said segments having an inner arc, an outer arc, and two end sections defining the entire peripheral edge of the segment, each of said inner arcs and said outer arcs having a corresponding center point defining a circle upon which each of said inner and outer arcs lie respectively, wherein the centerpoint of said inner arc and the centerpoint of said outer arc are offset by a predetermined distance, whereby when said arcuate segments are mated and engage said mandrel, the segments have a first orientation in which the peripheral edges abut to form stops that limit the relative rotation of the mandrel and the apparatus, and a second orientation in which the peripheral edges abut to form a generally round outer periphery.

17. Apparatus according to claim 16, further comprising an annular groove in the circumference of each of said segments, and a resilient fastener positioned in said groove to mate a pair of segments.

18. Apparatus according to claim 16, further comprising a second pair of mated segments, each pair being adapted for positioning near opposite ends of said coiling tube.

19. Apparatus according to claim 18, further comprising segment connectors fixed to opposed segments.

20. Apparatus according to claim 19, wherein said segment connectors are rods.

21. Apparatus according to claim 16, wherein the center of the circle defining the outer arc of a segment is off-set from the center of the circle defining the inner arc of the mandrelreceiving central cutout from about 0.015 to about 0.35 inches.

* * * * *